United States Patent [19]

Corneil

[11] Patent Number: 4,968,100

[45] Date of Patent: Nov. 6, 1990

[54] EXPANSION FRACTURE DEVICE

[76] Inventor: Dennis Corneil, 8 Woodycrest Avenue Downsview, Canada M4J 3A6

[21] Appl. No.: 306,389

[22] Filed: Feb. 6, 1989

[51] Int. Cl.[5] ..... F21C 37/10

[52] U.S. Cl. ..... 299/21; 29/113.1

[58] Field of Search ..... 299/20, 21; 166/187; 138/93; 277/34, 34.6; 29/113.1

[56] References Cited

U.S. PATENT DOCUMENTS

| | | | |
|---|---|---|---|
| 1,630,470 | 5/1927 | Clifford | 299/21 |
| 1,808,162 | 6/1931 | Frantz | 29/113.1 X |
| 1,863,286 | 6/1932 | Sheppard | 299/21 |
| 1,915,687 | 6/1933 | Meyer | 299/21 |
| 2,856,002 | 10/1958 | True et al. | 166/187 X |
| 3,447,605 | 6/1969 | Uliczky et al. | 166/187 |
| 4,657,306 | 4/1987 | Koopmans et al. | 299/21 |
| 4,711,501 | 12/1987 | Maeda et al. | 299/21 |

*Primary Examiner*—Ramon S. Britts
*Assistant Examiner*—David J. Bagnell

[57] ABSTRACT

An expansion fracture device for fracturing rocks and the like and having a rod, threads at least one end, a conduit in at least one end extending inwardly along the rod, and outwardly to the exterior of the rod. Collars are located at each end, defining axially opposed sealing faces directed towards one another, each of the opposed faces defining generally axially disposed tapering recesses. An expandable sleeve member formed of resilient plastic material surrounds the rod, and has two ends, each end defining generally tapering surfaces adapted to fit within respective tapering recesses defined by the axially opposed surfaces of the collars.

8 Claims, 2 Drawing Sheets

EXPANSION FRACTURE DEVICE

The invention relates to an expansion fracture device, for fracturing rock, concrete, and the like, by an hydraulic pressure medium.

BACKGROUND OF THE INVENTION

It is known that rock, concrete, and the like can be fractured by applying an expansion force from within a borehole. Forces in the region of 10,000 to 15,000 lbs. per square inch over an adequate surface area will usually be sufficient for the purpose, although clearly much higher forces can be developed if required. In the past, proposals have been made for developing expansion forces mechanically. However, such systems were complex and prone to failure. In addition, since in many cases the forces which they developed tended to be localized, instead of spread around 360 degrees, and over a sufficient area, the forces were not developed in a manner which was adequate to fracture the rock.

Hydraulic devices have been proposed, but are either complex in design, or are apparently unsatisfactory for other reasons. One of the particular problems in developing a hydraulic device is that generally speaking such devices are based upon the use of an expandable sleeve or bladder, which is located on a tubular body, and in which the bladder is retained on the tubular body by means of end flanges. Hydraulic fluid is forced via the tubular body into the bladder, typically at pressures up to 10,000 to 12,000 psi. These pressures cause the bladder to expand outwardly into contact with the rock. The actual force applied to the rock is a function of the square inch area of the bladder surface, and may be as much as one million pounds of force, which is usually sufficient to fracture the rock. However, substantial forces are also applied to the two end flanges attached to the tubular body.

In the case of, for example, a three inch borehole requiring an expansion member of almost three inches diameter, the two end flanges may represent a relatively substantial surface area. When this surface area is subjected to a pressure of, say 10,000 psi, it will be appreciated that there may be a very substantial total axial force applied to each of the end flanges which may be in the region of 80,000 to 100,000 pounds. The tubular body, and the means whereby the end flanges are attached to it must thus be designed and engineered to withstand these very high axial forces.

In the case of expansion devices for smaller diameter boreholes, while the total force applied to each of the end flanges may be somewhat less, it will be appreciated that the diameter of the internal tubular body will also be less. Many steels will not withstand these high axial stresses.

A further problem in earlier designs of expansion devices, was the design of the bladder. In many cases, the bladder was of a relatively complex design, requiring special moulding techniques. Typically such bladders are made of a tough resilient flexible thermoplastic material. Polyurethane materials are suitable, and other specialized thermoplastics are also suitable. In each case, however, it is preferable that the bladders shall be formed in a mould, either by injection moulding, or casting, or the like, so as to ensure that they are of substantially identical dimensions, and can be produced at a reasonable cost. Bladders of a special design may require costly tooling and expensive moulding techniques.

Another problem in earlier designs, arises again from the design of the bladder or sleeve. It is necessary to seal each end of the bladder against the escape or extrusion, of hydraulic fluid, between the ends of the bladder, and the end flanges. Various different proposals have been made, none of which were entirely satisfactory. In addition, in several prior designs, the design required a substantial space between the central tube, and the interior of the bladder. This space must be filled with hydraulic fluid before the device can apply force to the rock. Thus it will take a considerable period of time for pumping of hydraulic fluid into the space. The requirement for a substantial volume of hydraulic fluid within the device will also reduce the efficiency of the device, due to the compressibility of the fluid. While in theory hydraulic fluids are incompressible, in practice, at these higher pressures, such fluids exhibit a relatively significant degree of compressibility. Since compressibility is obviously a function of the total volume of fluid within the device, it will be appreciated that efficiency will be greatly reduced if an excessive volume of fluid is present.

In addition, the space must be completely vented of air before the device will develop its full force potential.

Another factor in earlier designs is that due to the provision of the substantial space between the bladder and the tube, the diameter of the tube is substantially reduced, thereby reducing its ability to withstand axial stresses.

Another significant factor arises from these same considerations. Where the bladder defines end flanges of a significant area, enclosing a substantial hydraulic volume, then the abutting end flanges on the rod also define a substantial annular surface area at each end of the device. This annular surface area is exposed to the hydraulic pressure developed within the bladder. It will be appreciated that the larger the surface area of these end flanges, the greater will be the axial force developed. The force will be a function of the internal pressure, multiplied by the surface area of the end flanges. It will be appreciated, therefore, that increasing the area of the end flanges and thereby reducing the diameter of the internal tube rapidly reaches critical proportions. The smaller the diameter of the internal tube, the smaller will be its ability to resist axial stresses. Conversely, the greater the area of the end flanges, the greater will be the axial forces developed in use.

As a result, it is apparent that it is highly desirable to increase the diameter of the central rod and, at the same time, reduce the area of the end flanges.

When this is understood, it will also be appreciated that when the diameter of the central rod is maximized, and the area of the end flanges is minimized, the hydraulic volume within the sleeve or bladder which must be filled each time it is used will be reduced to a minimum. This will also reduce the cycling time of the device and reduce the time required to operate the pump, or other pressure device used to provide the hydraulic pressure, and will also minimize compressibility problems.

It is also a desirable feature if such devices can be connected together in tandem, to provide expansion forces over a greater axial distance.

BRIEF SUMMARY OF THE INVENTION

With a view to overcoming the various problems noted above, the invention comprises an expansion fracture device, in turn, comprising a high tensile rod definng two ends, attachment means at at least one of said ends, conduit means in at least one of said end extending inwardly along said rod, and diagonally outwardly to the exterior of said rod adjacent at least one of said ends, collar means at each said end, said collar means defining axially opposed faces directed towards one another, each of said opposed faces defining in section generally axially disposed tapering recesses, and, an expandable sleeve member formed of resilient plastic material surrounding said rod, and having two ends, each said end defining generally tapering surfaces adapted to fit within respective said tapering recesses defined by said axially opposed surfaces of said collar means.

More particularly, it is an objective of the invention to provide an expansion fracture device having the foregoing advantages wherein at least one of said collar means comprise a generally cylindrical collar having interior threads adapted to be received on exterior threads formed on an end of said rod.

It is a further and related objective of the invention to provide an expansion fracture device having the foregoing advantages, and further including flow control valve means, and axial passageway means extending from one end to the other of said rod, whereby to conduct fluid along such central axis.

More particularly, it is an objective of the invention to provide an expansion fracture device having the foregoing advantages, and including threaded recess means formed in one end of said rod, and removeable plug means adapted to be disposed in said recess.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
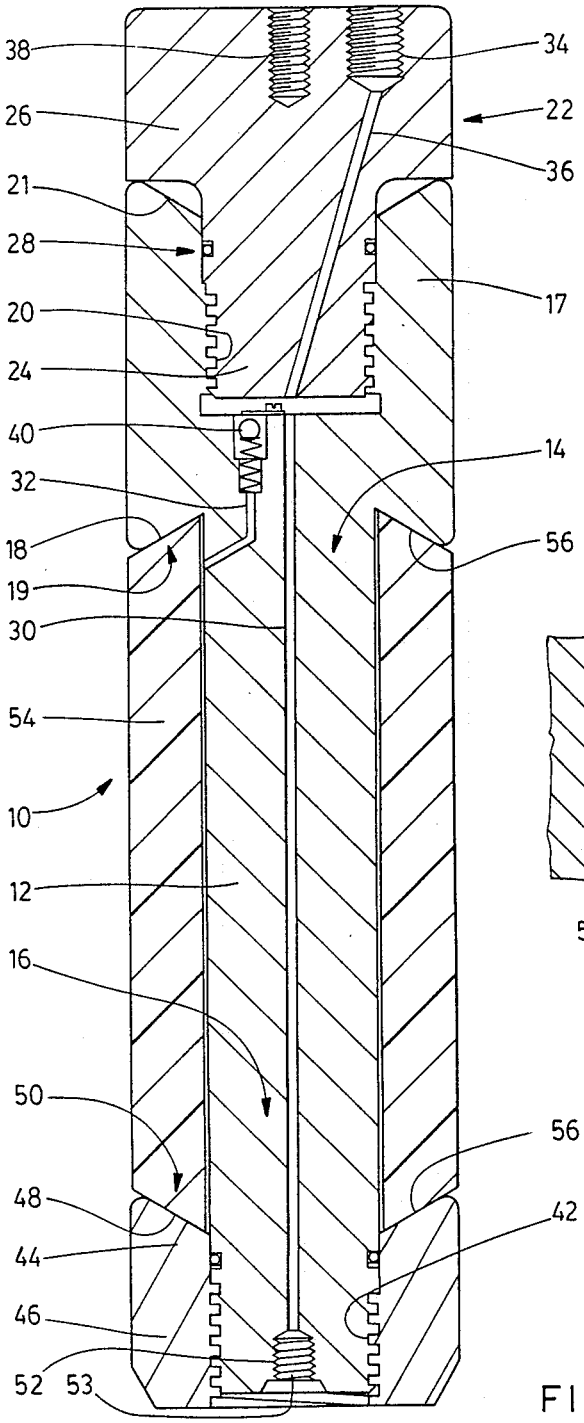
FIG. 1 is a sectional illustration of an expansion fracture device in accordance with the invention, with a central portion omitted for the sake of clarity.

Referring first of all to FIG. 1, the invention is illustrated in the form of an expansion fracture device 10, adapted to be inserted in a borehole in rock, concrete, or the like, which is not illustrated for the sake of clarity. Typically, such boreholes may be either of one and a half inch diameter or three inch diameter, in a manner well known in the art. However, other diameters may be used, and in that case the expansion device 10 will be designed to the appropriate size of borehole. The figures of one and a half inches, and three inches are given simply for the sake of explaining the nature of the calculation of the forces which will appear below.

As shown in FIG. 1, the embodiment of the invention as illustrated comprises a central axial high tensile rod 12, of a predetermined diameter, formed of any suitable material such as steel adapted to withstand the axial forces developed during the use of the device, described below. The rod 12 is of regular cylindrical shape along its length, and defines upper and lower ends 14 and 16, the terms upper and lower being used for convenience only, and without limitation.

Collar means 17 is formed integral with one end, in this case the upper end 14, and defines an annular angled sealing face 18. Sealing face 18 defines in section a generally tapering recess indicated as 19, which in the embodiment illustrated is of generally conical shape, although such face 18 may in fact be either conical, or semi-spherical, or partially conical and semi-spherical, or simply curved around any suitable arc. It will be apparent that the recess 20 tapers inwardly from the exterior to the interior, that is to say towards the rod 12.

Collar means 17 defines a junction face 21 defining a conical shape identical to the shape of sealing face 18, for reasons to be described below.

The exterior of collar means 17 is of a greater diameter than rod 12, and in turn is formed with an axial threaded recess 20. Threaded recess 20 is adapted to receive an hydraulic coupling member 22, having a male threaded portion 24, and an enlarged head portion 26.

Suitable anti-extrusion sealing means 28 (see FIG. 2) are provided for reasons to be described below.

In this embodiment of the invention, rod 12 is provided with a central axial passageway 30, extending from upper end 14 to lower end 16. A side conduit 32 is provided adjacent to central passageway 30, and defines a path extending to the exterior of rod 12, adjacent upper end 14.

Coupling member 22 is formed with an hydraulic connection means 34, in this embodiment, consisting of a threaded recess, which in this embodiment is offset from the central axis of the member 22 as shown. Passageway 36 extends from connection means 34, to the lower end of coupling member 22, for conducting hydraulic fluid therethrough. Hydraulic fluid passing through passageway 36 will thus be communicated both to the central axial passageway 30 and to the side conduit 32.

A central threaded pulling recess 38 is provided, for connection to any suitable pulling means such as a wire cable and threaded connection (not shown) such as is well known in the art, by means of which the entire device may be pulled from a bore hole.

A one-way flow control valve 40 is provided in side conduit 32, for reasons to be described below.

At the other end, in this case the lower end 16 of the rod 12, the rod 12 is formed with external threads 42, and sealing means 44, similar to the sealing means 28, for reasons to be described below.

An internally threaded annular collar means 46 is adapted to be received on the threads 42. Collar means 46 defines an annular angled sealing face 48, similar to sealing face 18 of collar member 17. Sealing face 48 defines an inwardly and downwardly tapered recess 50.

An enlarged threaded recess 52 is formed along the central axis of lower end 18, connecting with the central axial passageway 30, and is adapted to receive a closure plug 53 for reasons to be described below.

An expansion bladder member 54 is received on rod 12, and extends between sealing faces 18 and 48 of respective collar means 17 and 46. Bladder member 54 is formed of resilient expandable material such as urethane, or other synthetic material, and is of cylindrical shape along its length, both along its exterior and interior, and is adapted to make a close fit around rod 12. Both ends of bladder member 54 define angled sealing surfaces 56—56, adapted to abut against and mate with the sealing faces 18 and 48 of the collar means 17 and 46.

In operation, assuming the expansion device 10 of FIG. 1 is being used alone, then plug 53 is inserted in recess 52. Hydraulic fluid is then filled through the recess 34, and the air within the conduits and other spaces in the devices, are allowed to escape.

A suitable hydraulic high pressure coupling hose (not shown) is then connected to the coupling 34, and a hoisting means (not shown) is preferably connected to the recess 38. The device 10 is then inserted into a bore hole of suitable size. A pump (not shown) is then operated to supply hydraulic fluid under pressure to the passageway 36. Hydraulic fluid will then flow through the side conduit 32, and fill the space between the rod 12 and the expansion bladder device 54. The expansion bladder device 54 being made of resilient expandable material such as urethane, or other suitable material, will then expand into contact with the surfaces of the bore hole. As further fluid is forced into the device, the pressure will then build up. Once a sufficient pressure is reached, the material surrounding the bore hole, i.e., either rock, concrete or the like, will then fracture.

By suitable controls (not shown) the pump will then cease to operate, and the pressure within the device will then drop. The device can then be extracted from the fractured material around the bore hole, and the hydraulic fluid will then flow back into the supply system.

During this operation, the seals 28 and 44 (as illustrated in the enlarged detail circled in FIG. 1 will function to prevent extrusion of hydraulic fluid at either end of the device. Such seals will preferably include an O-ring indicated as 57, and an anti-extrusion ring 58, typically being formed of a more or less rigid thermoplastic material, in a manner known per se, such that when the O-ring 57 is subjected to the pressure of the hydraulic fluid in the device, it will not be squeezed into the opening between the one member and the other.

Figure 3:
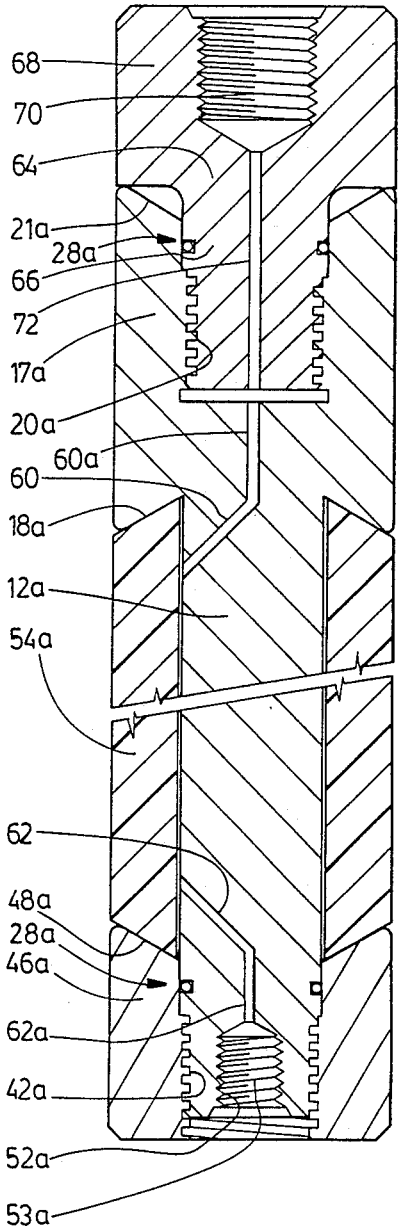
FIG. 3 is a sectional illustration of an alternate form of expansion device.

An alternate embodiment of the invention is shown in FIG. 3. This form of the invention may be more suitable for use in bore holes of a lesser diameter than that for which the device of FIG. 1 is intended.

It is formed with a central rod **12*a*, collar means 17*a* formed integrally at its upper end, having essentially the same features as the collar means 17 of the embodiment of FIG. 1. At its lower end, it is formed with threads 42*a* similar to the threads 42 of FIG. 1, and collar means 46*a* is adapted to be received on such threads 42*a*, in the same manner as in FIG. 1**.

An expansion bladder member **54*a* is received between the two collar means 17*a* and 46*a*, in the same manner as in FIG. 1. In this embodiment of the invention, however, the conduit means comprises upper and lower conduit portions 60 and 62. Conduit 60 has an upper central axial conduit portion 60*a*, and extends diagonally to the exterior rod 12*a*. Lower conduit 62 has a lower central axial conduit portion 62*a* and extends diagonally to the exterior of rod 12*a***.

An hydraulic connection member 64 is provided at the upper end, having a lower threaded portion 66 received within threaded recess **20*a*, and an upper enlarged head portion 68. An hydraulic coupling recess 70 is formed in head 68, and communicates with a central axial passageway 72, extending downwardly through portion 66**.

Hydraulic fluid is thus able to pass down through passageway 72 and into angled conduit 60.

Figure 2:
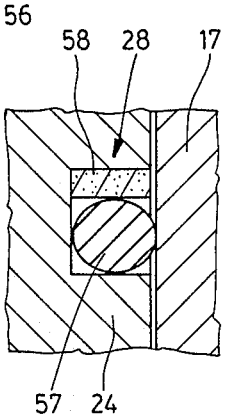
FIG. 2 is an enlarged section of the detail of a seal of FIG. 1 shown in the circle 2.

Seals 28A similar to seals 28 of FIGS. 1 and 2 and incorporating extrusion rings in a manner known per se (not shown) will be provided as in FIGS. 1 and 2.

In the operation of this form of the device, when used alone, a plug member **53*a* is secured in recess 52*a*. Hydraulic fluid is then filled into the device and the device is then bled to release air. The hydraulic supply means (not shown) is then connected to the coupling recess 70. The device is then inserted into a bore hole of an appropriate diameter. A pump (not shown) is then operated to supply hydraulic fluid under pressure. This operated to supply hydraulic fluid under pressure. This will then flow downwardly through passageway 72 and conduit 60 and fill the space between expansion member 54*a* and rod 12*a*. Expansion member 54*a*** will then expand into contact with the rock or concrete or the like material will yield and the pressure within the device will immediately drop. The pump (not shown) will discontinue operation, and the device can then be withdrawn.

It will be appreciated that in many circumstances it is desirable to operate two or more of such devices as shown in FIG. 1 or in FIG. 3, in tandem.

Figure 4:
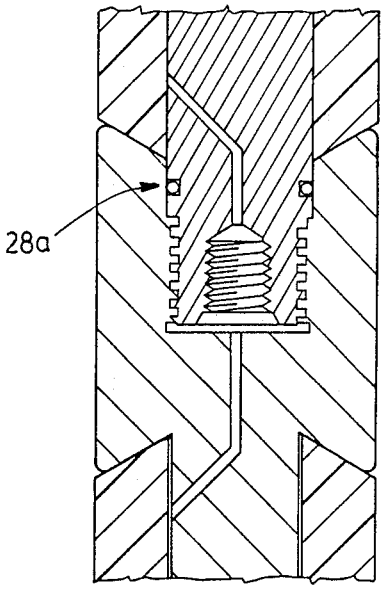
FIG. 4 is a sectional view of the interconnection of two expansion devices, in accordance with FIG. 3, and, FIG. 5 is a partial sectional illustration showing two of the devices of FIG. 1, connected in tandem.

In this case, as generally schematically illustrated in FIG. 4, two or more devices as illustrated in FIG. 3, may be associated together end to end.

It will be appreciated that as shown in FIG. 4, in the two such devices, of FIG. 3, the collar 46A, and plug **53*a* has been removed from one device, and the hydraulic connection member 64, has been withdrawn from the next device. The threads 42*a*, are then inserted within the threaded recesses 20*a* of the collar 17*a*** of the next device in tandem.

The junction face **21*a* of one of the devices will replace the sealing 48*a* of the collar means 46*a*** of the other device.

In this way two or more such devices may be used end for end in tandem.

It will be appreciated that in the illustration of FIG. 4 only portions of the respective devices have been shown.

It will, of course, be appreciated that the devices of FIG. 1 may also be connected together in tandem in the same way as the devices of FIG. 3.

Figure 5:
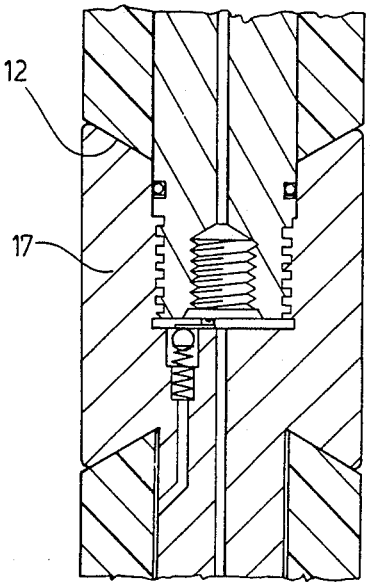

An example of two FIG. 1 devices, connected in tandem, is shown in FIG. 5.

Again, as described in connection with FIG. 4, the collar and plug of one device are removed, and the hydraulic connection member of the next device is removed, and the two devices may then simply be threaded together.

It will be appreciated that while two such devices are shown connected in this way, three or even many more such devices may be connected either of the FIG. 1 type or of the FIG. 3 type.

In the event that the devices as illustrated in FIG. 1 are being used in tandem, then it is possible that one of the bladders 54 of the device may register with a fissure in an ore body. In this case, it will almost certainly rupture. In this case, the pressure within that device will simply drop to zero and the hydraulic fluid will leak out. This would normally cause loss of pressure in all of the other devices coupled in tandem. However, in order to prevent this problem, from being transmitted to all of the hydraulic devices in tandem, the one-way flow control valve 40 is so designed that upon a sudden flow of fluid passing along the conduit 32, as the result of, for example, a rupture of the bladder 54, then flow control valve 40 will simply close. The remaining devices can then be pressured until such time as the rock fractures.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An expansion fracture device comprising:

rod means defining two ends;

attachment means at at least one of said ends;

conduit means in at least one said end extending inwardly along said rod means and outwardly to the exterior of said rod means adjacent at least one of said ends;

flow control valve means in said conduit means;

collar means at each said end, said collar means defining axially opposed faces directed towards one another, each of said opposed faces defining in section generally axially disposed tapering recesses, and, an expandable sleeve member formed of resilient plastic material surrounding said rod means, and having two ends, each said end defining generally tapering surfaces adapted to fit within respective said tapering recesses defined by said axially opposed surfaces of said collar means.

2. An expansion fracture device as claimed in claim 1 wherein at least one of said collar means comprise a generally cylindrical collar having interior threads adapted to be received on exterior threads formed on an end of said rod.

3. An expansion fracture device as claimed in claim 1, and including axial passageway means extending from one end to the other of said rod means, whereby to conduct fluid therealong.

4. An expansion fracture device as claimed in claim 3, and including threaded recess means formed in one end of said rod means, and removeable plug means adapted to be disposed in said recess means.

5. An expansion fracture device comprising:

rod means defining two ends;

attachment means at at least one of said ends;

conduit means in at least one said end extending inwardly along said rod means and outwardly to the exterior of said rod means adjacent at least one of said ends;

collar means formed integrally with said rod means at one end thereof;

threaded recess means formed in said rod means, said conduit means extending from said threaded recess;

an hydraulic coupling device having a threaded coupling portion adapted to be received in said threaded recess means, and defining a fluid passageway therethrough.

collar means at the other said end, said collar means at both said ends defining axially opposed faces directed towards one another, each of said opposed faces defining in section generally axially disposed tapering recesses, and, an expandable sleeve member formed of resilient plastic material surrounding said rod means, and having two ends, each said end defining generally tapering surfaces adapted to fit within respective said tapering recesses defined by said axially opposed surfaces of said collar means.

6. An expansion fracture device as claimed in claim 5, wherein said integral collar means is formed with a junction surface defining in section a generally axially disposed tapering recess, around said threaded recess, and wherein said rod means defines at its end remote from said integral collar means, a threaded connection means adapted to be received in said threaded recess in a said integral collar means of a next adjacent fracture device.

7. An expansion fracture device comprising:

a continuous one piece integral rod defining two ends of predetermined fixed length;

attachment means at at least one of said ends;

first conduit means in one said end extending inwardly along said one piece integral rod and outwardly to the exterior of said one piece integral rod adjacent said end;

second conduit means at the opposite end of said one piece integral rod extending inwardly along said one piece integral rod and outwardly to the exterior of said one piece integral rod adjacent said other end.

8. An expansion fracture device as claimed in claim 7 including threaded recess means formed in said other end of said one piece integral rod in registration with said second conduit, and removeable plug means adapted to be disposed of in said threaded recess means.

* * * * *